United States Patent [19]

Oba

[11] Patent Number: 4,747,379

[45] Date of Patent: May 31, 1988

[54] IDLE SPEED CONTROL DEVICE AND METHOD

[75] Inventor: Hidehiro Oba, Aichi, Japan

[73] Assignee: Toyota Jidosha Kabushiki Kaisha, Aichi, Japan

[21] Appl. No.: 89,545

[22] Filed: Aug. 26, 1987

[30] Foreign Application Priority Data

Sep. 10, 1986 [JP] Japan ..... 61-211716

[51] Int. Cl.[4] ..... F02D 9/02

[52] U.S. Cl. ..... 123/339; 364/431.07; 364/431.1

[58] Field of Search ..... 123/339, 486; 364/431.07, 431.1

[56] References Cited

U.S. PATENT DOCUMENTS

| | | | |
|---|---|---|---|
| 4,344,399 | 8/1982 | Matsumura | 123/339 |
| 4,389,996 | 6/1983 | Yaegashi | 123/339 |
| 4,545,349 | 10/1985 | Ito | 123/339 |
| 4,580,535 | 4/1986 | Danno | 123/339 |
| 4,625,697 | 12/1986 | Hosaka | 123/339 |
| 4,702,210 | 10/1987 | Yasuoka | 123/339 |

*Primary Examiner*—Ronald B. Cox

*Attorney, Agent, or Firm*—Parkhurst & Oliff

[57] ABSTRACT

An idle speed control method in which a feedback control for controlling the number of idle revolutions to a predetermined value, a learning control for determining a learning value needed to maintain the number of idle revolutions at the predetermined value, and an opening of the idle speed control valve are carried out. The feedback control is carried out when a predetermined feedback condition is satisfied, the learning control is carried out when a predetermined learning condition is satisfied, and the opening of the idle speed control valve is carried out when the feedback condition is not satisfied. Namely, if the present degree of opening of the idle speed control valve is larger than the learning value, the present degree of opening is maintained, and if the present degree of opening of the idle speed control valve is smaller than the learning value, the degree of opening is increased to the learning value. Also disclosed is a device for carrying out above method.

10 Claims, 4 Drawing Sheets

IDLE SPEED CONTROL DEVICE AND METHOD

BACKGROUND OF THE INVENTION

1. Field of the Invention

The present invention relates to a device and a method for controlling an idle speed by opening and closing a bypass passage connecting portions of an intake passage upstream and downstream of a throttle valve.

2. Description of the Related Art

An idle speed control device is used to adjust a degree of opening of an idle speed control valve provided in the bypass passage to control the idle speed to a set value. In a known idle speed control device, a feedback control and a learning control is carried out to control the idle speed to a target value. The feedback control is carried out when a feedback condition occurs in which, for example, an idle switch is turned ON and the vehicle speed is 0 km/h, so that the degree of opening of the idle speed control valve is changed to bring the idle speed to the target value. The learning control is carried out when a learning condition occurs in which, for example, the feedback control is carried out and the temperature of the cooling water is higher than 80° C., so that a learning value of the degree of opening of the idle speed valve, by which the idle speed is brought to the target value, is determined. The degree of opening of the idle speed control valve is set to the learning value when the feedback condition is not satisfied and an open-loop control is carried out.

In another known device, the degree of opening of the idle speed control valve is gradually brought to the learning value when the feedback condition is not satisfied. However, if the learning value is abnormally small, the degree of opening of the idle speed control valve also becomes too small, so that the number of engine revolutions is reduced, and thus the engine tends to stop when the accelerator is released during running of the vehicle to close the throttle valve and decelerate the vehicle.

In a further known device, when the feedback condition is not satisfied, the degree of opening of the idle speed control valve is maintained at the value at which the degree of opening for the feedback control was carried out until that point. However, if the degree of opening of the idle speed control valve is too small when the feedback control is stopped, the engine will easily stall, as in the above-mentioned device.

Japanese Unexamined Utility Model Publication No. 60-188840 discloses a construction in which, when a correction coefficient of the feedback control is a negative value, the correction coefficient is fixed to zero, so that engine stalling is prevented when the open-loop control is stopped and feedback control started.

SUMMARY OF THE INVENTION

Therefore, an object of the present invention is to provide a device and a method by which, when an open-loop control is stopped and a feedback control started, engine stalling is prevented even when the throttle valve is closed.

The present invention provides an idle speed control device for adjusting a flow passage area of a bypass passage connecting portions of an intake passage upstream and downstream of a throttle valve, to control an idle speed. The idle speed control device comprises an idle speed control valve, a feedback control means, a setting means, and an opening means. The idle speed control valve is provided in the bypass passage to change a flow passage area thereof. The feedback control means controls the degree of opening of the idle speed control valve to maintain the idle speed at a predetermined value until a predetermined feedback condition is satisfied. The setting means sets a learning value of the degree of opening of the idle speed control valve needed to maintain the idle speed at a predetermined value, and determines the learning value when a predetermined learning condition is satisfied. The opening means opens the idle speed control valve when the feedback condition is not satisfied. Namely, the opening means maintains the degree of opening of the idle speed control valve if the present degree of opening is larger than the learning value, and increases the degree of opening of the idle speed control valve to the learning value if the present degree of opening is smaller than the learning value.

The present invention also provides an idle speed control method. The method according to the present invention comprises the steps of carrying out a feedback control of the degree of opening of the idle speed control valve, setting a learning value of the degree of opening of the idle speed control valve, and opening the idle speed control valve.

The feedback control step is carried out to control the degree of opening and maintain an idle speed at a predetermined value until a predetermined feedback condition is satisfied.

The setting step sets the learning value when a predetermined learning condition is satisfied. The learning value is provided to maintain the idle speed at a predetermined value.

The opening step is carried out when the feedback condition is not satisfied. The opening step maintains the degree of opening of the idle speed control valve if the present degree of opening is larger than the learning value, and increases the degree of opening of the idle speed control valve to the learning value if the present degree of opening is smaller than the learning value.

BRIEF DESCRIPTION OF THE DRAWINGS

The present invention may be more fully understood from the description of preferred embodiments of the invention set forth below, together with the accompanying drawings, in which.

DESCRIPTION OF THE PREFERRED EMBODIMENTS

Figure 1:
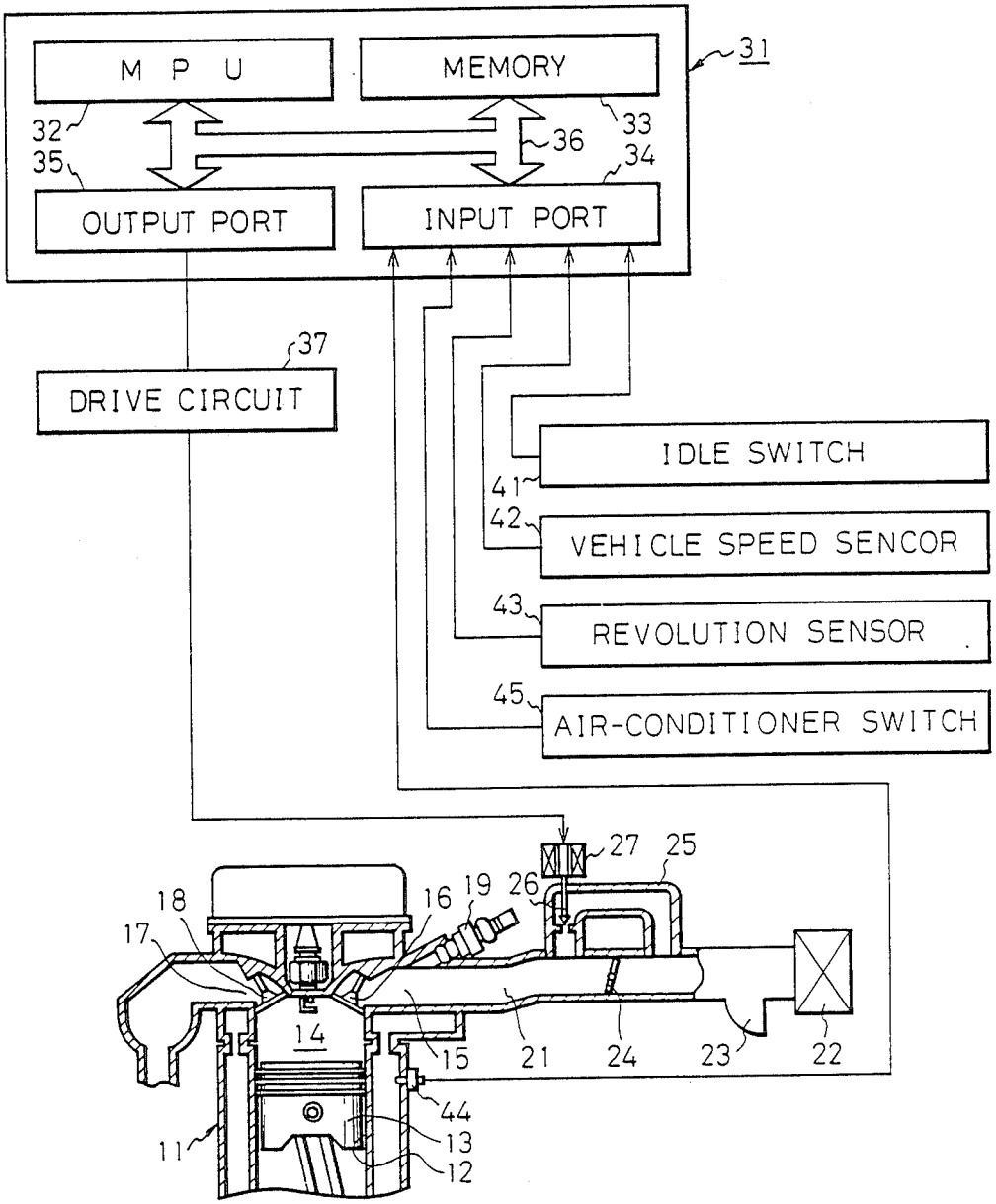
FIG. 1 is a sectional view of an internal combustion engine to which an embodiment of the present invention is applied.

The present invention will now be described with reference to the embodiments shown in the drawings.

FIG. 1 shows an engine having an idle speed control device as an embodiment of the present invention. A cylinder block 11 is formed with a cylinder bore 12, in which a piston 13 is slidably housed to form a combustion chamber 14. An intake port 15 and an exhaust port 17 are open or closed by an intake valve 16 and exhaust valve 18, respectively. A fuel injector 19 is provided near the intake port 15. An air filter 22 and an air flow meter 23 are provided in the most upstream portion of an intake passage 21 which communicates with the intake port 15, and a throttle valve 24 is provided downstream of the air flow meter 23.

Portions of the intake passage 21 upstream and downstream of the throttle valve 24 are connected by a bypass passage 25. The flow area of the bypass passage 25 is changed by an idle speed control valve 26, which is a linear solenoid valve. The degree of opening of the idle speed control valve 26 is controlled by an Electronic Control Unit (ECU) 31 during an idle running of the engine to control the idle speed. The degree of opening of the idle speed control valve 26 is adjusted by a duty ratio of a time for which an electric current is applied to a solenoid 27; the idle speed control valve 26 being fully closed when the duty ratio is 0%, and fully open when the duty ratio is 100%.

The ECU 31 is provided for setting the duty ratio of the time for which the electric current is applied to the solenoid 27 of the idle speed control valve 26. The ECU 31 is constructed by a microcomputer that includes a microprocessing unit (MPU) 32, a memory 33, an input port 34, an output port 35, and a bus 36 interconnecting these components.

The input port 34 receives several kind of signals indicating engine conditions.

For example, as shown in FIG. 1, an idle switch 41 is connected to the throttle valve 24 to output an ON signal when the degree of opening of the throttle valve 24 is smaller than a predetermined value, and a vehicle velocity sensor 42 is disposed in a transmission (not shown) to output a signal corresponding to a vehicle speed. A revolution sensor 43 is disposed in a distributor (not shown) to output a signal corresponding to the number of engine revolutions, and a water temperature sensor 44 is attached to the cylinder block 11 to sense a cooling water temperature and output a signal corresponding to that temperature. An air-conditioning switch 45 is provided in an air-conditioner (not shown) to output a signal when the air-conditioner is turned ON.

The output port 35 is connected to the solenoid 27 of the idle speed control valve 26 through a drive circuit 37, and the MPU 32 calculates the duty ratio of a time for which an electric current is applied to the solenoid 27 in accordance with a program stored in the memory 33.

Figure 2:
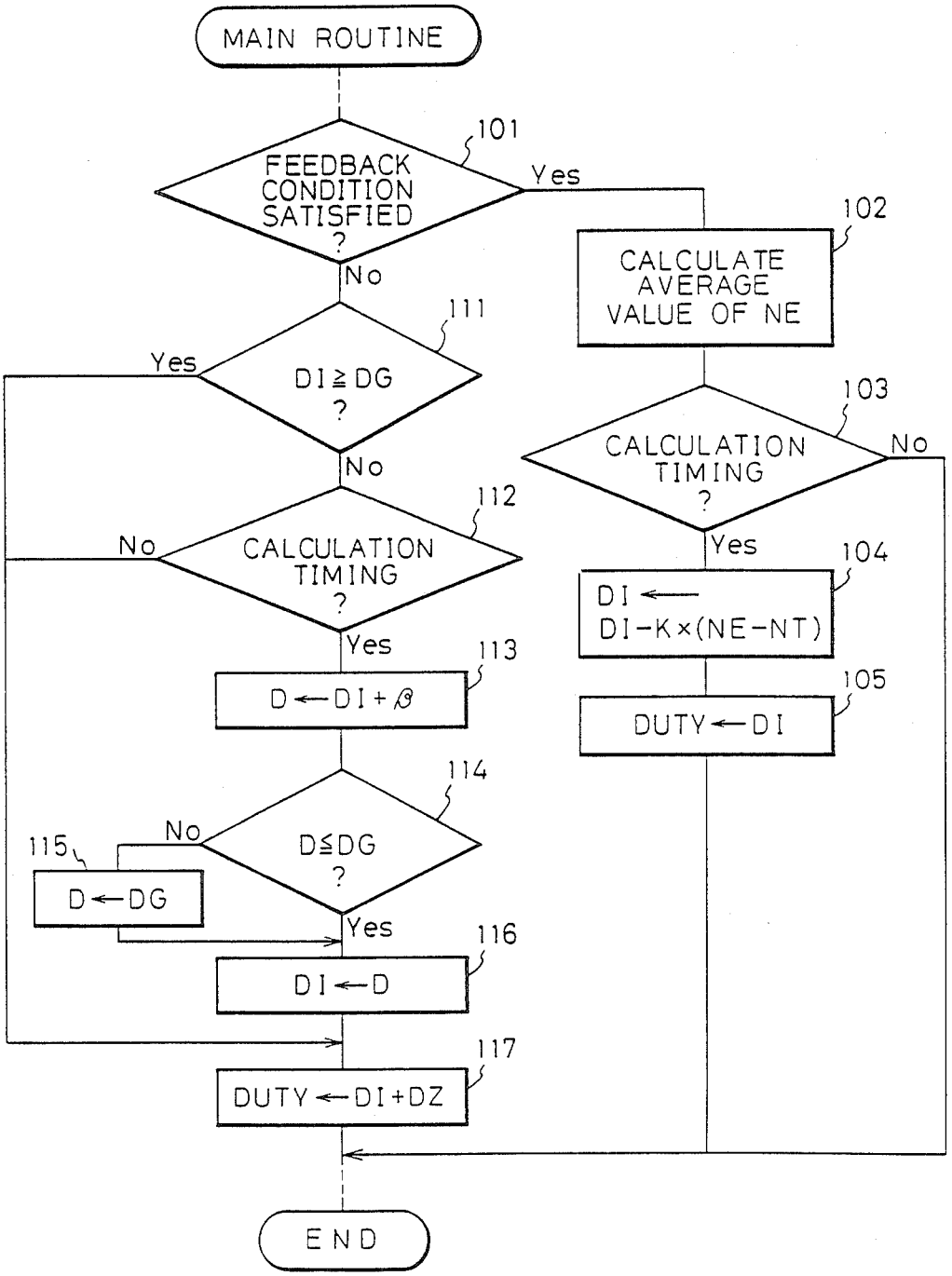
FIG. 2 is a flow chart of a part of the main routine according to the present invention.

FIG. 2 shows a flow chart of a part of a main routine for carrying out control of the engine. In this main routine, the process is returned to the first step after the process has reached the last step, and thus the process is carried out repeatedly for as long as the engine is operated.

In the step 101, it is determined whether or not the feedback condition is satisfied. In this embodiment, the feedback condition is satisfied when the idle switch is turned ON, the vehicle speed is 0 km/h, the cooling water temperature is higher than 70° C., and the air-conditioner switch is turned OFF, and further, when these conditions have been maintained for more than δseconds.

When the feedback condition is satisfied, the process proceeds to step 102, where an average value of the number of engine revolutions from the finish of the previous execution of step 105 or 117 to the start of the present execution of step 102 is calculated. In step 103, it is determined whether or not the calculation timing is a present timing, i.e., permissible. The calculation timing occurs, for example, at every 120° crank angle.

The term "calculation timing" as used herein denotes the timing at which the ECU 31 is permitted to calculate the duty ratio.

If the calculation timing is permissible, the process then proceeds to step 104. If the calculation timing is not permissible, the steps 104 and 105, in which a duty ratio is calculated, are skipped and the process returns to the starting point.

In step 104, a difference between the present number of engine revolutions NE and the target number of idle revolutions NT is calculated, and is multipled by a coefficient K. The product is subtracted from a basic opening command value DI of the idle speed control valve 26 which has been stored to the memory 33, so that a new basic opening command value DI is calculated. Thus, if the present number of engine revolutions NE is larger than the target number of idle revolutions NT, the basic opening command value DI is decreased and a flow passage area of the bypass passage 25 is reduced. Conversely, if the present number of engine revolutions NE is smaller than the target number of idle revolutions NT, the basic opening command value DI is increased. In step 105, the basic opening command value DI is converted to a duty ratio DUTY representing a time for which an electric current is applied to the solenoid 27 of the idle speed control valve 26.

Thus, the degree of opening of the idle speed control valve 26 is adjusted so that the number of idle revolution approaches the target value. The steps 102 through 105 are carried out several times and thus, the number of idle revolutions reaches the target value. At this point, the drive circuit 37 outputs an interrupt pulse A at every constant period T, and at the same time, applies an electric current to the solenoid 27. The time for which an electric current is applied is equal to the product of the constant period T and the duty ratio DUTY, i.e., $T \times DUTY$. The electric current is shut off when a time signal input from a timer (not shown) coincides with the constant time T.

If the feedback condition is not satisfied in step 101, the process proceeds from step 101 to step 111, and an open-loop control is carried out. In step 111, it is determined whether or not the basic opening command value DI of the idle control valve 26 now stored in the memory 33 is larger than the learning value DG. If this is the first time that step 111 has been carried out after the feedback condition is not satisfied, this basic opening command value DI is equal to the basic opening command value DI in the feedback control carried out just before the open-loop control is started. The learning value DG is determined so that the number of idle revolutions is a value within a predetermined limit, by a learning control routine (FIG. 4) described later.

In step 111, if the basic opening command value DI is larger than the basic opening learning value DG, the process is proceeds to step 117, where an idle-up correction coefficient DZ is added to the basic opening command value DI, so that the duty ratio DUTY of the time for which an electric current is applied to the solenoid 27 is changed. The idle up correction coefficient DZ is calculated by adding together the values of any increases in the number of idle revolutions due to a low cooling water temperature, an electric load, and an engine start. Thus, when the feedback condition is not satisfied, if the present basic opening command value DI for the idle speed control valve 26 is larger than the learning value DG, the present basic opening command value DI is maintained.

Conversely, if the present basic opening command value DI is smaller than the learning value DG in step 111, steps 112 through 116 are carried out so that the basic opening command value DI is gradually increased to the learning value DG. In step 112, it is determined whether or not calculation is permissible at the present calculation timing. If the present timing corresponds to a predetermined crank angle or a pulse signal of every constant period is input, for example, calculation is permissible at the present calculation timing, and therefore the process proceeds to step 113. Conversely, if calculation is not permissible at the present calculation timing, the process proceeds to step 117 and the duty ratio DUTY is calculated. As can be understood from the above description, the timing at which these steps can be carried out depends upon many other factors, and therefore, if step 113 were to be carried out continuously, the speed at which the basic opening command value DI is increased would become uncertain, thus the calculation timing is determined to prevent any such uncertainty.

Figure 3:
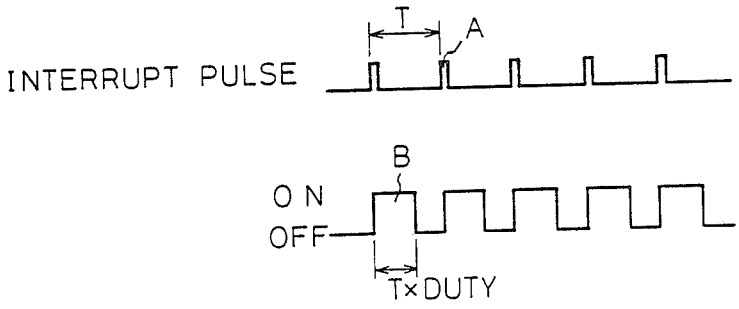
FIG. 3 is a graph showing a signal for a duty control for the idle speed control valve.

In step 113, an increase coefficient $\beta$ is added to the basic opening command value DI to calculate a correction coefficient D. The increase coefficient $\beta$ is a small value, for example, 0.025 through 1%. In step 114, it is determined whether or not the correction coefficient D is smaller than the learning value DG. If the correction coefficient D is smaller than the learning value DG, the process proceeds to step 116 and the basic opening command value DI is replaced with the correction coefficient D. If the correction coefficient D is larger than the learning value DG, the learning value DG is input to the correction coefficient D in step 115 and the correction coefficient D is then input to the basic opening command value DI in step 116, so that the basic opening command value DI is substituted by the learning value DG. Thus, the basic opening command value DI is gradually brought to the learning value DG. Then, in step 117, the correction coefficient DZ is added to the command value DI and the duty ratio DUTY is calculated. Note that an output of the duty ratio DUTY is carried out at the same timing as shown in FIG. 3 and described above with reference to that drawing.

Figure 4:
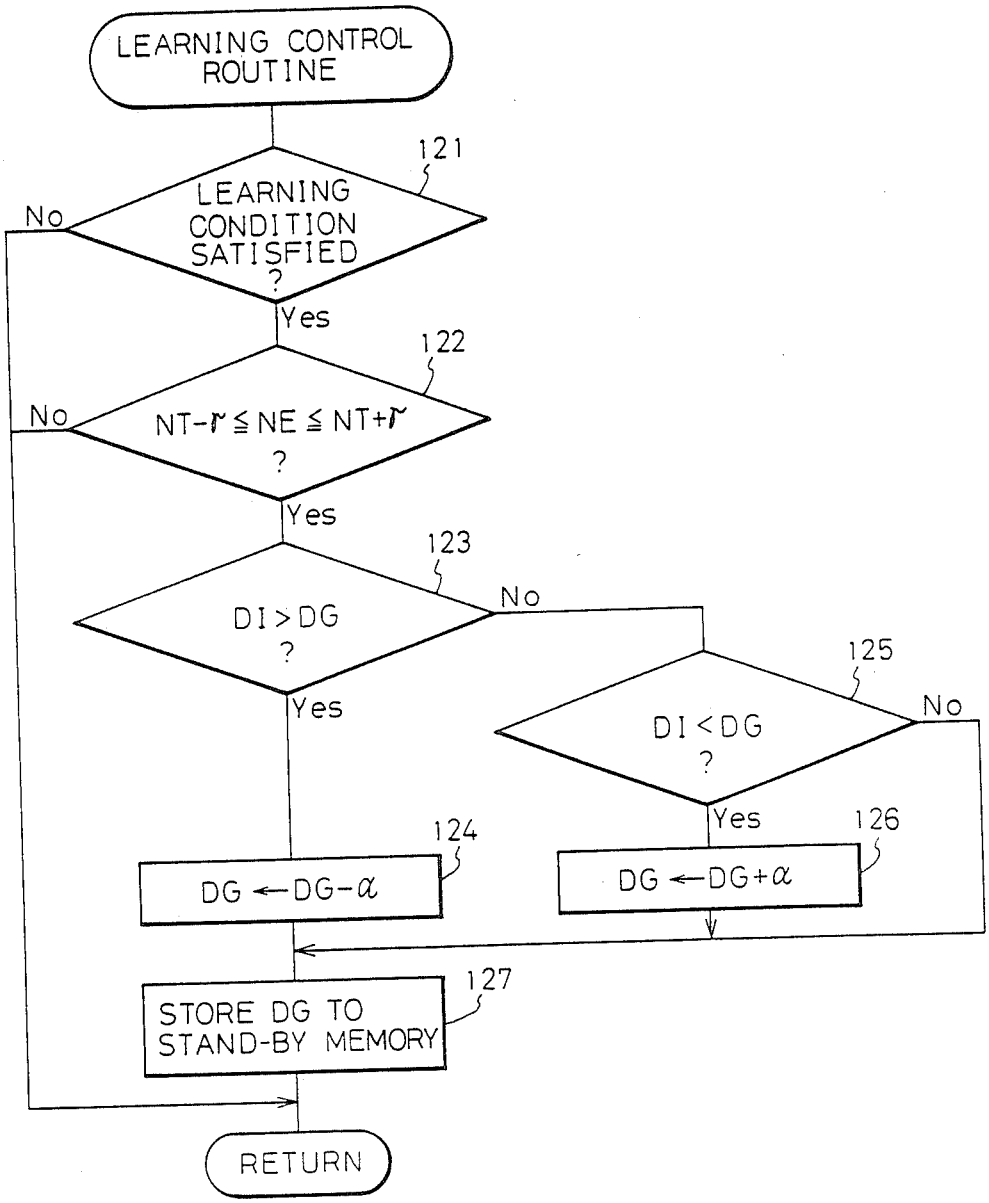
FIG. 4 is a flow chart of a learning control routine according to the present invention.

FIG. 4 shows a learning control routine for setting the learning value DG. This routine is carried out at a constant crank angle.

In step 121, it is determined whether or not the learning condition is satisfied. The learning condition is satisfied when the feedback control is being carried out and the cooling water temperature is higher than 80° C. in this embodiment. If the learning condition is satisfied, the process proceeds to step 122. If the learning condition is not satisfied, the process is ended and steps 122 through 127 are omitted.

In step 122, it is determined whether or not the present number of engine revolutions NE is within a predetermined limit. The predetermined limit is calculated as (the target number of revolutions NT+an error $\gamma$), the error $\gamma$ being for example, 20 rpm. If the number of engine revolutions NE is not within the predetermined limit, the routine is ended immediately since the learning value DG can not be changed. Conversely, if the number of engine revolution NE is within the predetermined limit, the process proceeds to step 123 for changing the learning value DG. In step 123, it is determined whether the basic opening command value DI is larger than the learning value DG. If the basic opening command value DI is larger than the learning value DG, in step 124 a correction coefficient $\alpha$ is subtracted from the present learning value DG, and thus a new learning value DG is obtained. Conversely, if the basic opening command value DI is not larger than the learning value DG, in step 125 it is determined whether or not the basic opening command value DI is smaller than the learning value DG. If the basic opening command value DI is smaller than the learning value DG, in step 126 the correction coefficient $\alpha$ is added to the present learning value DG and a new learning value DG is obtained. If the basic opening command value DI is equal to the present learning value DG, the present learning value DG is maintained at that value. Note that the correction coefficient $\alpha$ is a small value, for example, between 0.1 and 1%. Then, in step 127, the learning value DG is stored in the Stand-by RAM, and the routine is then ended.

As described, in this embodiment, when the feedback condition is not satisfied, if the present basic opening command value DI for the idle speed control valve 26 is larger than the learning value DG, the present command value DI is maintained. Therefore, even if the learning value DG is a smaller value than a value which should exist, the degree of opening of the idle speed control valve 26 is prevented from becoming too small when the control is changed from a feedback control to an upon open-loop control, so that the engine is prevented from stalling upon deceleration. An abnormally small learning value DG can occur due to the occurrence of the following conditions:

(1) the learning value in the Stand-by RAM is cleared and an initial value, which is very small, is input to the RAM due to a disconnection of the battery from the ECU 31.

(2) when the vehicle is running at a high altitude after a learning control has been completed and a learning value set while the vehicle was running at a low altitude, the learning value cannot be increased immediately since the learning control cannot be carried until the feedback control is started, to immediately open the idle speed control valve 26 and since the learning control process must go through a certain number of steps, there is maintain the same number of engine revolutions, and a delay between the time at which the learning value is changed and the time at which the feedback control is started, and during this period, the control is changed to an open-loop control.

In this embodiment, when the feedback condition is not satisfied, if the present command value DI is smaller than the learning value DG, the command value DI is gradually increased to the learning value DG. Therefore, when the control is changed to an open-loop control, even if the command value DI is very small, if the learning value DG is set to a correct value, the opening of the idle speed control valve 26 is prevented from becoming too small since the command value DI is close to the learning value DG, so that the engine is prevented from stalling upon deceleration.

Note that, in the above embodiment, although the target number of idle revolutions NT is fixed to a constant value for the feedback control (steps 102 through 105 in FIG. 2), the condition of the cooling water temperature may affect the feedback condition, so that the target number of idle revolutions may be varied according to the cooling after temperature. The condition in which the air-conditioner switch is turned ON or OFF also may affect the feedback condition, so that the target number of revolutions may be varied according to the ON-OFF condition of the air-conditioner switch. If the feedback control is carried out while the air-conditioner switch is turned ON, since the basic opening command value DI includes an increase component due to an operation of the air-conditioner, the increase component must be subtracted from the target basic opening command value DI in the learning control (the routine of FIG. 4).

The drive mechanism for the idle speed control valve 26 may be a rotary solenoid or a pulse motor. When a pulse motor is used, a step position or an angular position of the step motor is used instead of the duty ratio DUTY.

Although embodiments of the present invention have been described herein with reference to the attached drawings, many modifications and changes may be made by those skilled in this art without departing from the scope of the invention.

I claim:

1. An idle speed control device for adjusting a flow passage area of a bypass passage connecting portions of an intake passage upstream and downstream of a throttle valve to control an idle speed, said idle speed control device comprising:

an idle speed control valve provided in said bypass passage for changing a flow passage area thereof;

means for feedback control of the degree of opening of said idle speed control valve, said feedback control means controlling the degree of opening to maintain the idle speed at a predetermined value when a predetermined feedback condition is satisfied;

means for setting a learning value of the degree of opening of said idle speed control valve needed to maintain the idle speed at a predetermined value, said setting means determining said learning value when a predetermined learning condition is satisfied; and means for opening said idle speed control valve which, when said feedback condition is not satisfied, maintains the degree of opening of said idle speed control valve if the present degree of opening is larger than said learning value, and increases the degree of opening of said idle speed control valve to said learning value if the present degree of opening is smaller than said learning value.

2. An idle speed control device according to claim 1, wherein said feedback control means controls the degree of opening of said idle speed control valve to maintain the idle speed at the predetermined value while the idle switch is turned ON, the vehicle speed is 0, the cooling water temperature is higher than 70° C., and the air-conditioning device is turned OFF.

3. An idle speed control device according to claim 1, wherein said feedback control means controls the degree of opening of said idle speed control valve to maintain the idle speed at the predetermined value while the idle switch is turned ON, the vehicle speed is 0, and the cooling water temperature is higher than 70° C.

4. An idle speed control device according to claim 1, wherein said setting means determines said learning value when said feedback control is carried out, and the cooling water temperature is higher than 80° C.

5. An idle speed control device according to claim 1, wherein said opening means gradually increases the degree of opening of said idle speed control valve to said learning value if the present degree of opening is smaller than said learning value.

6. An idle speed control method for adjusting a flow passage area of a bypass passage connecting portions of an intake passage upstream and downstream of a throttle valve by controlling an idle speed control valve provided in said bypass passage to control an idle speed, said idle speed control method comprising the steps of:

carrying out a feedback control of the degree of opening of said idle speed control valve to control the degree of opening and maintain the idle speed at a predetermined value when a predetermined feedback condition is satisfied;

setting a learning value of the degree of opening of said idle speed control valve needed to maintain the idle speed at a predetermined value, when a predetermined learning condition is satisfied; and opening said idle speed control valve, when said feedback condition is not satisfied, to maintain the degree of opening of said idle speed control valve if the present degree of opening is larger than said learning value, and to increase the degree of opening of said idle speed control valve to said learning value if the present degree of opening is smaller than said learning value.

7. An idle speed control method according to claim 6, wherein said feedback condition is satisfied if the idle switch is turned ON, the vehicle speed is 0, the cooling water temperature is higher than 70° C., and the air-conditioning device is turned OFF.

8. An idle speed control method according to claim 6, wherein said feedback condition is satisfied if the idle switch is turned ON, the vehicle speed is 0, and the cooling water temperature is higher than 70° C.

9. An idle speed control method according to claim 6, wherein said learning condition is satisfied if said feedback control is carried out, and the cooling water temperature is higher than 80° C.

10. An idle speed control method according to claim 6, wherein the degree of opening of said idle speed control valve is increased gradually to said learning value if the present degree of opening is smaller than said learning value.

* * * * *